US006422578B1

(12) United States Patent
Oh

(10) Patent No.: US 6,422,578 B1
(45) Date of Patent: Jul. 23, 2002

(54) IN-LINE SKATE WITH AUXILIARY WHEEL, AUXILIARY WHEEL AND METHOD

(76) Inventor: Joshua Oh, 833 Fieldale Ln., Grayslake, IL (US) 60030

( * ) Notice: Subject to any disclaimer, the term of this patent is extended or adjusted under 35 U.S.C. 154(b) by 0 days.

(21) Appl. No.: 09/431,944

(22) Filed: Nov. 1, 1999

(51) Int. Cl.[7] ..... A63C 17/04; A63C 17/02

(52) U.S. Cl. ..... 280/11.232; 280/11.223

(58) Field of Search ..... 280/11.2, 11.22, 280/809, 11.27, 11.26, 11.28, 87.041, 87.042, 297, 304, 293, 11.206, 11.207, 11.208, 11.216, 11.221, 11.222, 11.223, 11.232; 301/5.3, 5.23

(56) References Cited

U.S. PATENT DOCUMENTS

| | | | | |
|---|---|---|---|---|
| 108,184 A | | 10/1870 | Pollitt | |
| 1,393,813 A | * | 10/1921 | Muck | 280/809 |
| 2,529,314 A | | 11/1950 | Schmid | 280/11.23 |
| 2,776,845 A | * | 1/1957 | Pearl | 280/304 |
| 2,784,008 A | * | 3/1957 | Pearl | 280/304 |
| 2,817,540 A | * | 12/1957 | Pawsat | 280/304 |
| 4,615,535 A | * | 10/1986 | McMurtrey | 280/293 |
| 4,618,158 A | | 10/1986 | Liberkowski | 280/11.1 |
| 5,183,276 A | * | 2/1993 | Pratt | 280/11.22 |
| 5,192,088 A | | 3/1993 | Yu | 280/11.22 |
| 5,295,701 A | | 3/1994 | Reiber et al. | 280/11.27 |
| 5,312,165 A | | 5/1994 | Spletter | 301/5.23 |
| D347,672 S | * | 6/1994 | Arney et al. | 280/809 |
| 5,630,624 A | * | 5/1997 | Goodman | 280/809 |
| 5,655,785 A | * | 8/1997 | Lee | 280/11.22 |
| 5,732,957 A | | 3/1998 | Yu | 280/11.19 |
| 5,899,465 A | | 5/1999 | Mayer, II | 280/11.2 |

OTHER PUBLICATIONS

On–line abstract and front page of U.S. Patent No. 4,394, 028, Jul. 19, 1983, Wheelwright.

* cited by examiner

*Primary Examiner*—Brian L. Johnson
*Assistant Examiner*—Gerald Klebe
(74) *Attorney, Agent, or Firm*—Joan I. Norek; The Law Office of Joan I. Norek

(57) ABSTRACT

An in-line skate has an auxiliary wheel rotatably mounted in a raised position relative the primary wheels at the side of the longitudinal alignment of primary wheels. A conventional in-line skate can be retrofitted with an auxiliary-wheel assembly having an auxiliary wheel mounted for rotation on an axle journalled onto a mounting member, which assembly can be easily attached to a conventional in-line skate. Using such an in-line skate, a hockey stop can be readily performed in a method of in-line skating.

21 Claims, 4 Drawing Sheets

IN-LINE SKATE WITH AUXILIARY WHEEL, AUXILIARY WHEEL AND METHOD

BACKGROUND OF THE INVENTION

In-line skates are roller skates with the rollers or wheels in an in-line configuration, that is a single row or line of wheels mounted one behind the other along the toe-to-heel lines of the skates. Conventional roller skates ("roller skates") have two sets of side-by-side wheel pairs, the pairs mounted one behind the other. Both in-line skates and roller skates typically have their wheels mounted for rotation about fixed axes, the wheels rolling simultaneously in the same direction, either forward or backwards.

The in-line configuration of the wheels of in-line skates somewhat resembles the single blade of conventional ice skates. Moreover, in-line skates replicate to a significant degree the feel of ice skates. Unlike ice skates, however, skating on in-line skates does not require real or artificial ice. Therefore the skater is far less restricted as to the times and places available for skating. For these and possibly other reasons in-line skates have grown immensely popular in recent years. They are not only being used for casual recreational purposes, but they are also being used to play the sport of hockey.

For the sport of hockey in-line skates have been widely used for off-ice training. Many people are learning to play traditional ice hockey by starting first on in-line skates. Experienced ice hockey players are improving their skills by off-ice training and practice on in-line skates. In addition, in-line skate hockey has itself become a sport, some people playing only in-line hockey and others playing both in-line and traditional ice hockey. In-line skate hockey, often referred to as roller hockey, has boosted the opportunities of non-professional players to play hockey, and reduced the costs of providing suitable hockey rinks.

In ice skating, the most common and effective manner of stopping abruptly is a stop known as the hockey stop. The skater makes a sharp turn transverse to the direction of his forward motion, turning the skate blades transverse or crossways to the skater's forward motion. Concomitantly with turning, the skater leans his body away from the forward-motion direction. The blade edges bite into the ice and the forward motion is arrested with a little sideways sliding, while the skater's balance is maintained.

A hockey stop on in-line skates is generally not possible. A sharp transverse turn on in-line skates typically will result in an instantaneous cessation of skate movement, the skates then acting as a stationary pivot point about which the skater's body revolves, falling forward. Instead of achieving a sharp stop, the skater experiences a sharp fall because in-line skates will not slide sideways along the skating surface. (An attempt to moderate the immediate cessation of skate movement while trying to execute a hockey stop by turning at a lesser angle to forward motion will only result in circular motion.) The small degree of sideways sliding and the slight giving or shaving of the ice surface experienced in ice skating are absent when using in-line skates on a solid surface.

The ability to stop is important in any type of skating. It is a safety issue for even the most casual recreational skater. Moreover, hockey is a sport that involves abrupt stops and quick turns. Quick and agile movements on skates are among the core skills of this sport. The inability to execute hockey stops on in-line skates is a limitation on the training usefulness of in-line skates for the sport of ice hockey, and detracts from the sport of roller hockey.

The typical braking accessory used on an in-line skate is a rubber bumper mounted on the heel of the skate. This bumper can be dragged along on the skating surface by inclining the skate to a heel-down, toe-up position. The bumper drag decreases forward-motion speed. Stopping with the assistance of such a bumper is far from abrupt and does not resemble the feel or movement of a hockey stop.

In-line skates used for ice-hockey training and/or roller hockey have become standardized to a significant degree. Even in-line skates used for strictly non-sporting recreational use have become rather standardized. These skates routinely have four simple primary wheels in in-line alignment and no other conspicuous skating props. (Specialized in-line skates for speed skating commonly have five primary wheels.) Wheel sizes and the skates are reasonably standardized so that there is a market of commercially-reasonable size for replacement wheels. Skates that depart from the simple norm, or are equipped with conspicuous appendages, or do not use standard replacement wheels that are readily available through mass merchandisers, would meet with serious consumer resistance. Consumer resistance would rise further if an accessory, even an accessory that facilitated hockey stops, were expensive and/or could not readily be fitted to standard in-line skates.

It is desirable to provide a means for readily performing a hockey stop on in-line skates. It is desirable to provide such a means that is neither expensive nor conspicuous. It is desirable to provide such a means with which standard in-line skates can be readily retrofitted. It is desirable to provide such a means that can be used for ice-hockey training and/or roller hockey and/or strictly non-sporting recreational use by skaters of all levels of skill. It is desirable to provide such a means that has a broad use range, and thus a broad consumer market, and therefore will in turn have significant appeal to mass merchandisers and thereby be widely available to consumers. It is also desirable to provide such a means that can be readily positioned or placed in accordance with a skater's personal preference.

BRIEF SUMMARY OF THE INVENTION

The present invention is an in-line skate having an auxiliary wheel rotatably mounted in a raised position relative the primary wheels at the side of the longitudinal alignment of primary wheels. The present invention is also an auxiliary-wheel assembly having an auxiliary wheel mounted for rotation on an axle journalled onto a mounting member, which assembly can be attached to a conventional in-line skate, whereby a simple retrofitting of that skate is achieved. The present invention also is a method of in-line skating using the in-line skate of the present invention to perform a hockey stop.

DETAILED DESCRIPTION OF THE INVENTION

Figure 1:
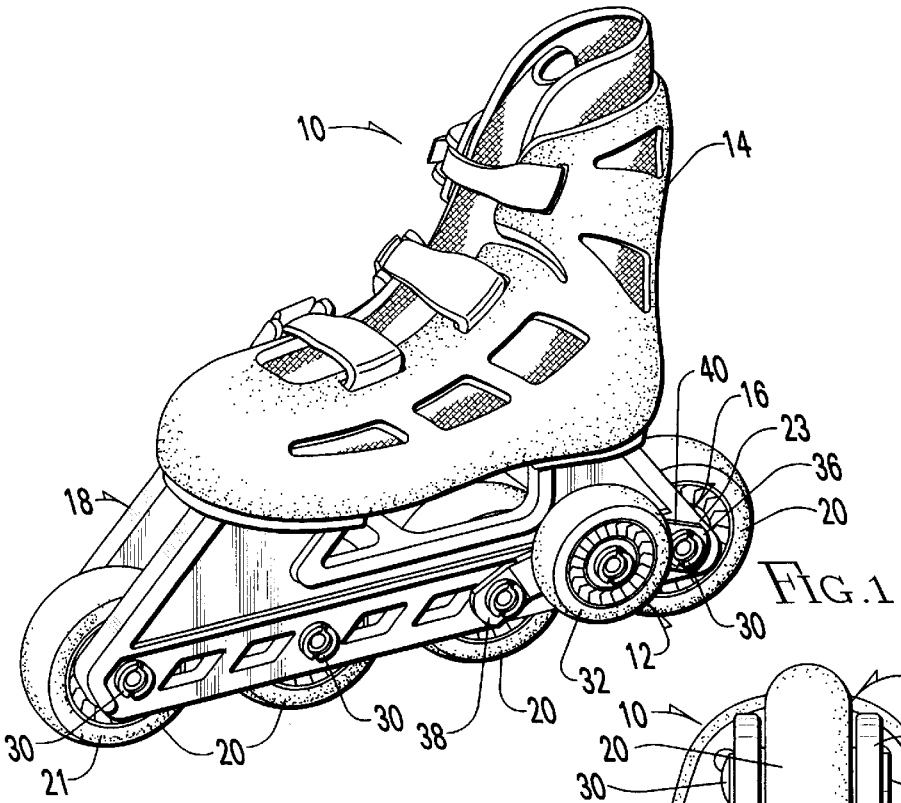
FIG. 1 is a partly diagrammatic perspective view of an in-line skate of the invention on which is mounted an auxiliary wheel of the invention.
Figure 2:
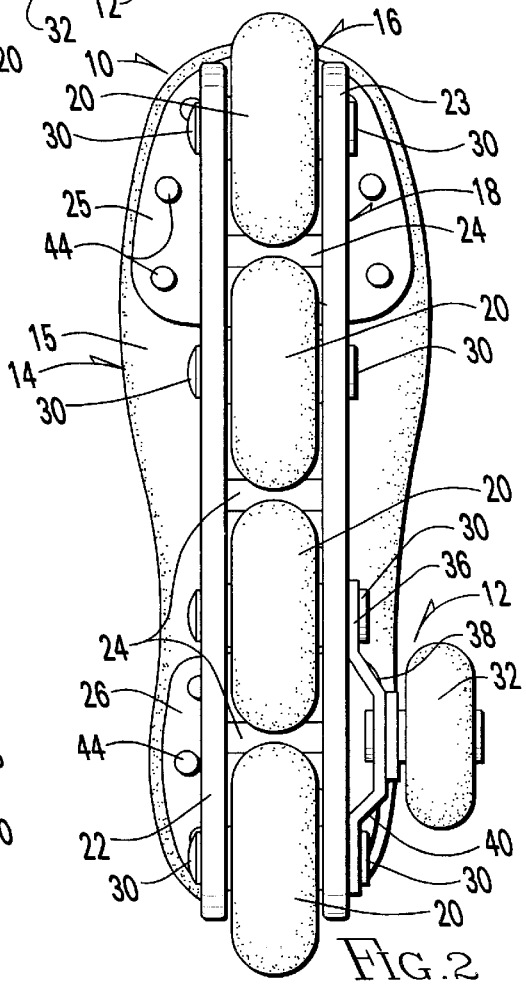
FIG. 2 is a partly diagrammatic bottom plan view of the in-line skate and the auxiliary wheel of FIG. 1.
Figure 3:
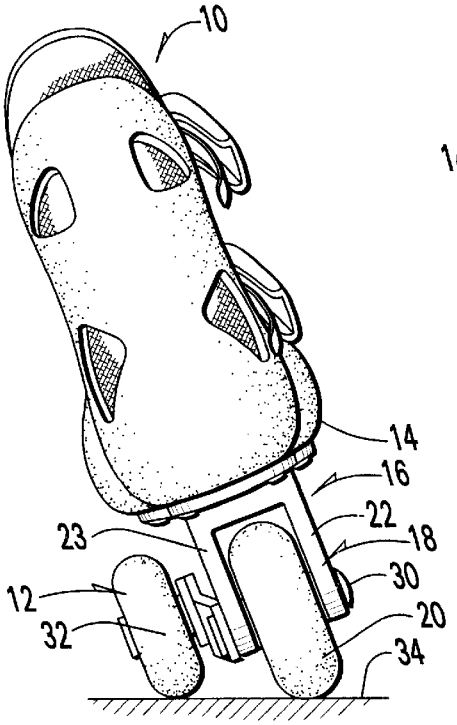
FIG. 3 is a partly diagrammatic rear end view of the in-line skate and the auxiliary wheel of FIG. 1 during the performance of a hockey stop.

There is shown in FIG. 1 to 3 an in-line skate of the present invention, designated generally by the reference number 10, on which is mounted an auxiliary-wheel assembly 12 of the present invention. As shown, the skate 10 has a conventional skate body or shoe boot 14, and a longitudinally-positioned primary-wheel assembly 16 mounted or otherwise affixed to the bottom 15 of the shoe boot 14.

The primary-wheel assembly 16 is comprised of a boot-mounted, wheel-mounting frame 18 and a plurality of primary wheels 20. The wheel-mounting frame 18 is comprised of two substantially-parallel spaced-apart flange members, namely a first or outer flange member 22 and a second or inner flange member 23, between which the primary wheels 20 are mounted. (The flange members 22, 23 form a primary-wheel channel or way.) The wheel-mounting frame 18 also includes a plurality of cross-members 24 and upper mounting plates, namely a forward mounting plate 25 and a rear or heel mounting plate 26. The flange members 22, 23 are substantially rigid structures having some degree of flexibility which extend down from the mounting plates 25, 26. The cross-members 24 are positioned primarily between primary wheels 20 and bridge the flange members 22, 23. As shown and conventionally, the wheel-mounting frame 18 is formed as a single molded plastic or aluminum structure. The frame 18 is mounted on the bottom 15 of the shoe boot 14 in conventional manner, for instance with the forward and heel plates 25, 26 positioned flat against the boot bottom at respectively the toe and the heel areas and fastened thereto with conventional mechanical fasteners, such as the rivets 44 shown.

The primary wheels 20 are mounted between the flange members 22, 23 on separate axles (not shown other than protruding screw heads). Each axle extends from the outer flange member 22 to the inner flange member 23 and is journalled therein, and secured thereon, in conventional (in-line skate) manner. Screw heads 30, positioned at the outer sides of the spaced-apart flange members 22, 23, are each affixed to the end of an axle and (other than about auxiliary-wheel assembly 12 of the present invention) they each tightly bear against one or the other of these flange members 22, 23. In other words, each of the axles are capped at each end with a screw head 30. Typically one screw head 30 is molded together with or otherwise permanently affixed to one end of an axle, and the axle at the opposite end is formed as a female element with internal threads that receives a threaded screw having a like screw head 30. Each screw head 30 has a hexagonal depression (not shown) that receives a standard Allen wrench for opening and tightening. The axles are aligned conventionally, parallel to one another, and the primary wheels 20 are lined up one behind the other, longitudinally from toe to heel, or in other words the primary wheels 20 are positioned in an in-line alignment. Except for the auxiliary-wheel assembly 12, the skate 10 is a standard, conventional in-line skate of the type most popular for roller hockey. (The term "roller hockey" as used hereinunder will refer to both ice-hockey training and roller hockey.)

As shown and conventionally, the first primary wheel 20, designated 20 also in FIG. 1 for further identification, is mounted somewhat raised above the other primary wheels 20 for skating speed and maneuverability, as is the toe section of a flange member of conventional ice skates. This conventional slightly-raised first primary wheel 20 has no relevance to the present invention, and thus will be, for simplicity, discussed as if it were not a raised wheel in the general description of the invention below.

The auxiliary-wheel assembly 12 is mounted on the outside surface of the inner flange member 23. The auxiliary-wheel assembly 12 is comprised of an auxiliary wheel 32 mounted for rotation on an auxiliary-wheel axle (not shown except for end head elements) journalled onto a mounting plate or winged mounting member 36 having a first and a second arm member 38, 40. The first arm member 3 8 and the second arm member 40 each have a hole or orifice (not shown) sized to readily receive one of the primary-wheel axles without excessive clearance. As shown, the auxiliary-wheel assembly 12 is attached to the skate 10 by the mounting of the first arm member 38 on the third primary wheel 20 (counting from toe to heel) and the second arm member 40 on the fourth or last primary wheel 20. Such a mounting positions the auxiliary wheel 32 itself about mid-way between the third and fourth primary wheels 20.

The auxiliary-wheel assembly 12 could instead be mounted at the first and second primary wheels 20 or the second and third primary wheels 20. It is believed that there is no functional advantage or disadvantage among these three mounting placements, except of course a skater's personal preference and/or skating style or method. As shown and in preferred embodiments of the present invention, the auxiliary-wheel assembly 12 can be mounted at any two adjacent primary wheels 20, providing three placement options in a skate having four primary wheels, and four placement options in a skate having five primary wheels. This array of placement options is a significant advantage and benefit to a skater who has a personal preference, regardless of whether that preference is dictated by the skater's skating style or method or not. This array of placement options is generally available using a single auxiliary-wheel assembly because the primary-wheel axle centers are conventionally equidistant.

In other embodiments (not shown) an auxiliary-wheel assembly having a longer mounting member could be mounted at non-adjacent primary wheels, for instance, at the first and fourth primary wheels, or at the first and third primary wheels. A mounting member that is simply formed of two arms, however, would be under greater stress in use if so stretched between two non-adjacent primary wheels, without any obvious advantages. Nonetheless in broad embodiment these mounting and placement variations are not excluded from the present invention.

The auxiliary wheel 32 is mounted raised (as measured at its lowest extent or bottom) relative the primary wheels 20. During straight-forward skating and the like, the primary wheels 20 are positioned substantially on and normal to the skating surface. The auxiliary wheel 32 substantially lies in a plane parallel to the primary wheels 20. The plane of the auxiliary wheel 32 therefore, like that of the plane of the primary wheels 20, is positioned normal or perpendicular to the skating surface. Because of its raised position, however, the auxiliary wheel 32 does not and cannot touch the skating surface when the skate 10 is substantially upright, such as during straight-forward skating or other skating in which the wheel planes are substantially normal or perpendicular to the skating surface. When so positioned elevated off of the skating surface, the auxiliary wheel 32 has no influence on the skating action. It also does not interfere in any way with the skating action. When performing a hockey stop, however, the skater makes a sharp turn and turns his skates transverse to the direction of his forward motion, while leaning his body (including his skates) away from the forward-motion direction. In a hockey stop using the auxiliary wheel of the present invention, the forward-most skate (which is the skate 10 as shown in FIG. 3) will incline until the auxiliary wheel 32 touches or butts against the skating surface 34 concomitantly with the primary wheels 20. The action will to a significant degree have the feel, and functionally mimic, the action of ice-skate flange member edges biting into ice. The skater's forward motion is arrested with a little sideways sliding, while the skater's balance is maintained.

In a hockey stop using the auxiliary wheel of the present invention, the rotations of all of the wheel elements (the primary wheels 20 and the auxiliary wheel 32) are substantially stopped. Unlike the stopping action of a conventional rubber bumper mounted on the heel of the skate, the braking action using the auxiliary wheel of the present invention is a cooperation of the frictional engagement of all wheel elements with the skating surface, that is, two parallel lines of wheel elements (or a parallel line of friction points side-by-side a single friction point) transverse to the existing direction of travel. This hockey stop, and the ease at which this hockey stop is performed, cannot be achieved with either the primary wheels 20 alone or with the auxiliary wheel 32 alone. The auxiliary wheel 32 also facilitates the skater's balance until a full stop has sufficiently approached that the skater can resume a more upright or erect posture. In a tight, but not a stopping, turn the outside skate generally will sufficiently incline inward that its auxiliary wheel 32 touches the skating surface. When the auxiliary wheel 32 so touches the ground on a tight non-stopping turn, it rolls with the skate and thereby actually stabilizes the turning action. A stationary bumper type of structure, in contrast, would catch the ground if it touched the ground, causing the skater to stumble or fall.

As shown and in preferred embodiment, the arms of the winged mounting member 36 each sit on an end section of one of the primary-wheel axles that extends beyond the inner flange member 23, and is held fast against the outside surface of the inner flange member 23 by the screw head 30. The threads of a threaded screw of a conventional in-line skate wheel are about 0.5 inch in length, and the internal threads of an axle are at least that deep. Normally it is the width of a primary wheel plus the widths of the flanking outer and inner flange members that are held tightly between screw heads. The approximately 0.5 inch length of the threaded screw member, however, permits the inclusion of a relatively thin mounting member arm among the layers sandwiched between screw heads without a decrease in the holding strength of the headed-axle/threaded screw assembly of any significance. It is believed that an additional width of up to about ⅜ or possibly even ½ inch can be accommodated without a loss of strength using the standard axle/screw hardware (normally provided with in-line skates as purchased). Longer axle/screw hardware can be substituted if the mounting-member arm is too thick to be safely accommodated, and such substitute hardware is readily available on the market. In no instance, however, should the axle be so long that a tight fit is not achieved.

In more detail, the same type of axle/screw hardware can be used, as shown, to mount the auxiliary wheel 32 to the center of the mounting member 36, at which point the first and second arms 38, 40 cross, as shown. The auxiliary-wheel axle thus is also a capped axle. It passes through the center of the auxiliary wheel 32 and both arm members 38, 40, and of course is capped at both ends. From the crossing area, both arm member 38, 40 flare somewhat rearward of the auxiliary wheel 32 so that their connection sections, that is the sections that include the orifices (not shown), both lie in the same plane, and further that plane is beyond the bulge of the rear axle cap. In other embodiments (not shown) the mounting member could be fabricated as a single-piece structure having approximately the same configuration. In broad embodiments (not shown) the mounting member can be any effective configuration, and/or can be attached to a skate by methods and means other than stringing it onto primary-wheel axles. In further broad embodiments (not shown) the auxiliary wheel can be fabricated as an integral, non-detachable component of the skate itself, for instance as an integral part of a wheel-mounting frame of a primary wheel assembly or the like.

In more detail, as shown in FIGS. 1 to 3, the primary wheels 20 as shown are about 2 ¾ inches high (2 ¾ inches in diameter) and about 0.9 inch wide (thick as measured respectively at longest diameter and at the widest point). The auxiliary wheel 32 is about 1 ⅝ inches high and about 0.5 inch wide, same basis. Both the primary wheels 20 and the auxiliary wheel 32 have sloping sides, tapering the wheel down to a circumferential center-line rounded point, which configuration is well known for in-line skate wheels. The slopes and roundness are sufficient so that more wheel surface is in contact with the skating surface when the skate 10 and its wheels are inclined in comparison to the contacting wheel surface when in the upright position, the latter more approaching a point contact. As shown, the lower-most surface of the auxiliary wheel 32 is raised about 1 inch off tie ground when the plane in which it lies is substantially perpendicular to the ground. As shown, the lower-most surface of the auxiliary wheel 32 is about ⅛ inch above the bottom edge of the inner flange member 23. The sideways distance between wheel circumferential center-lines is about 1.25 inches (comparing the imaginary longitudinal line running along the circumferential center lines of the primary wheels 20 with the parallel circumferential centerline of the auxiliary wheel 32). An auxiliary wheel can be of most any size provided it can be mounted, at a sufficiently raised position off the skating surface so that (1) it does not interfere with upright skating or reasonably tight turns and (2) it enables the performance of a hockey stop. Generally such a sufficiently raised position is from about 0.5 or 1 inch to about 2.5 inches, as measured when the skate is in an upright position.

The auxiliary-wheel assembly preferably is fabricated with sufficient strength and stiffness that it can endure the stresses encountered during the use for which it was fabricated. The auxiliary-wheel assembly preferably is fabricated with a sufficiently low weight so that it has little to no influence on balance. The auxiliary-wheel assembly preferably is fabricated with a sufficiently thin mounting member so that the auxiliary wheel is not excessively spaced apart from the alignment of primary wheels. For instance, when the mounting member of an auxiliary-wheel assembly is a simple two-armed wing structure like that shown in FIG. 1 to 4, about ⅛ thick aluminum provides a reasonable balance between strength, thickness and weight, being sufficiently strong to tolerate the strains and stresses of hockey use without distortion or failure, while placing the auxiliary wheel out a sufficient distance to the side and being sufficiently light in weight that any impact on balance is negligible. In contrast, a heavy gauge steel might provide sufficient strength but place the auxiliary wheel too far out to the side and/or have a noticeable influence on balance. As a safety measure, fabrication suitable for hockey action preferably should be adopted for recreational skating. On the other hand, the expense of fabrication with even more durable and/or more light-weight materials, such as carbon-resin composites, might reasonably be justified, at least for instance for particularly heavy-duty use.

All of the wheel elements, whether primary wheels or auxiliary wheels, may be fabricated of any suitable material having sufficient strength to withstand the stresses, wear and abrasion for which they are designed, such as for instance high-impact engineering thermoplastic materials. A hard wheel, such as a wheel having an 87A hardness (industry standards), is for instance generally considered suitable for rough outdoor surfaces. Softer wheels are frequently used to better grip smooth surfaces, such as many of the surfaces used for indoor in-line skating, although softer wheels are less durable. Nothing in the present invention limits the fabrication material to conventional in-line skate materials, and instead the fabrication material can be rubber, any of various plastics, composites and the like, provided that the material has sufficient strength and other structural properties suitable for the stresses, wear and abrasion for which it is designed.

The stress on the wheel-mounting frame by the drag of the auxiliary wheel 32 during a hockey stop is of course not negligible, particularly since the auxiliary wheel 32 of the embodiments shown is mounted outside of the inner flange member 23. The cross members 24 and the outwardly capped axles of the skate 10, which again is otherwise a conventional in-line skate, sufficiently strengthen the frame 18 so that the additional stress is withstood without loss of structural integrity.

Although a single skate 10 is shown in the drawings and is described above for simplicity, the present invention does not exclude the use of an auxiliary wheel on the inner side of both skates of a pair of skates, or just on the inner side of one skate in a pair. That can be a matter of a skater's personal preference, at least some skater's preferring to perform hockey stops in only a single direction, and thus preferring to carry an auxiliary wheel only on the skate that is positioned forward in that hockey stop. In addition, although in certain preferred embodiments the auxiliary wheel of the present invention is carried on the inner side of the skate (and thus the auxiliary wheel is very inconspicuous to the average observer), in broader embodiments the use of an auxiliary wheel of the present invention on the outer side of a skate is not excluded. For instance, a skater who prefers to perform hockey stops in only a single direction might prefer having an inner-side auxiliary wheel on the skate that is positioned forward in that hockey stop, plus an outer-side auxiliary wheel on the skate behind. (An inner-side auxiliary wheel on the rearward skate has no influence on the hockey stop. Some skater's might even prefer using only an outer-side auxiliary wheel on the skate normally rearward during the hockey stop.) Nonetheless the inner-side positioning of the auxiliary wheel is the positioning of preferred embodiments for a variety of reasons, including without limitation the more inconspicuous appearance, the ability to perform a hockey stop with that skate in a forward position, and the assistance provided to the outside skate in sharp turns.

When an auxiliary-wheel assembly is sized or otherwise adapted to be mounted at any two adjacent primary wheels, such as is shown for the auxiliary-wheel assembly 10 of FIG. 1 to 3, in other embodiments (not shown) a skater can used two such auxiliary-wheel assemblies on a single skate by mounting one assembly on the front two primary wheels and the other on the rear two primary wheels. Such in-tandem mounting of auxiliary-wheel assemblies will not interfere with sharp but non-stopping turns, each auxiliary wheel rotating together with the primary wheels in such a turn, and (when that skate is the forward skate) provides the second of two parallel lines of contact points during a hockey stop.

Figure 4:
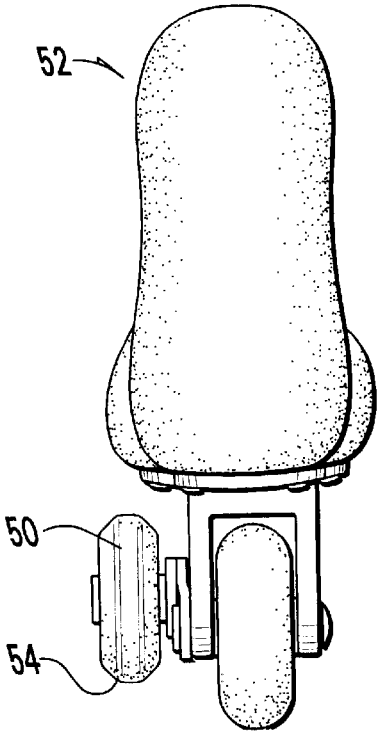
FIG. 4 is a partly diagrammatic rear end view of an in-line skate and an auxiliary wheel of the present invention.
Figure 5:
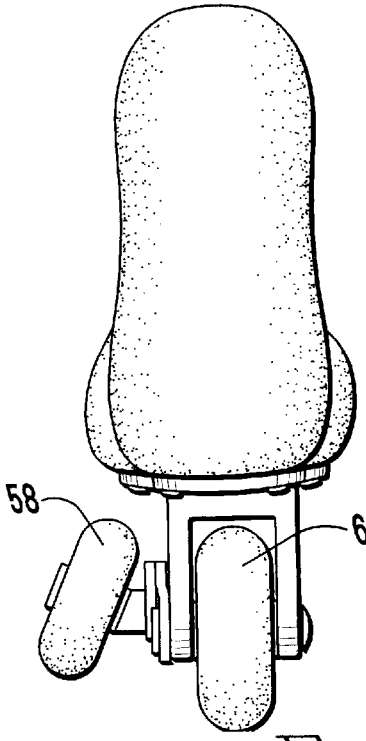
FIG. 5 is a partly diagrammatic rear end view of an in-line skate and an auxiliary wheel of the present invention mounted at an incline.
Figure 6:
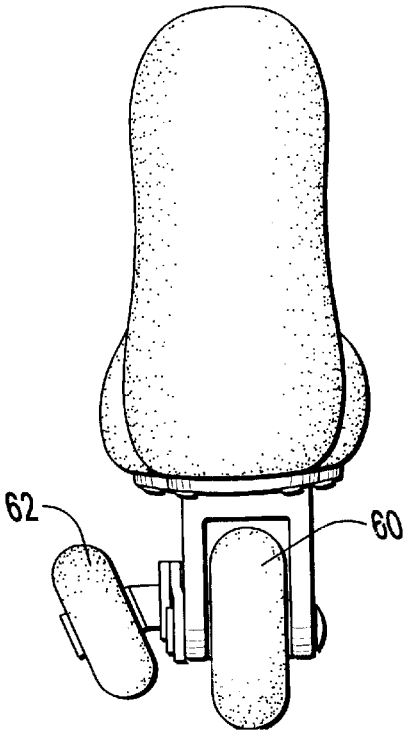
FIG. 6 is a partly diagrammatic rear end view of an in-line skate and an auxiliary wheel of the present invention mounted at an opposite incline.

Referring now to FIG. 4 to 6, there is shown several alternative embodiments of the invention whereby the contact area of the auxiliary-wheel during a hockey stop maneuver is increased. In FIG. 4 the auxiliary wheel 50 of the in-line skate 52 is formed with a distinctly hexagonal cross-sectional profile, each internal angle of which configuration is about 60° so that the bearing surface 54 of the auxiliary-wheel 50 is substantially flat against the skating surface during the execution of a hockey stop. The bearing surface 54 is therefore at about 60° incline from the skating surface when the skate 52 is positioned upright. In FIG. 5 the auxiliary wheel 58 is positioned inclined from the plane of the primary wheels 60, the bottoms approaching each other in a configuration approaching a V-shape, while in FIG. 6 the auxiliary wheel 62 is positioned inclined from the plane of the primary wheels 60, the tops approaching each other in a configuration approaching an inverted V-shape. With auxiliary wheels of conventional shape, the mountings shown in FIG. 5 and FIG. 6 will place somewhat more surface in contact with the skating surface during a hockey stop. The other components and method of skating in these alternate embodiments are as described elsewhere herein and for simplicity purposes will not be repeated.

Figure 7:
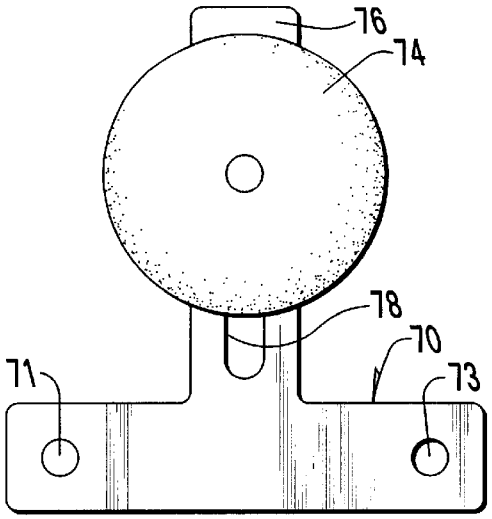
FIG. 7 is a partly diagrammatic side view of an auxiliary wheel assembly of the present invention.
Figure 8:
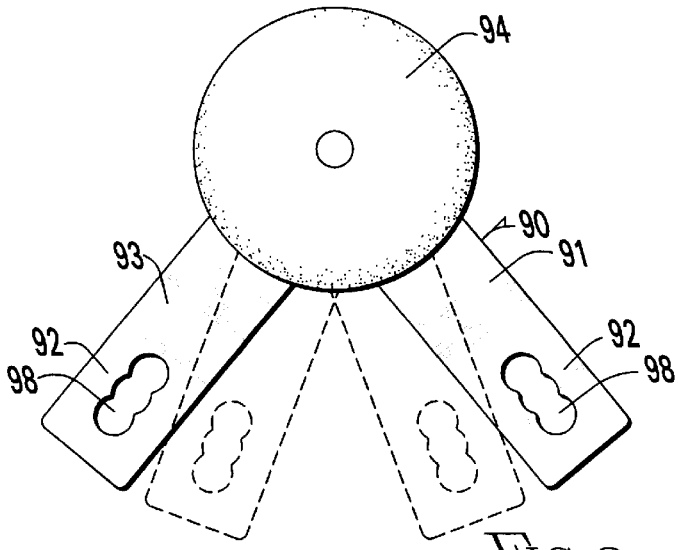
FIG. 8 is a partly diagrammatic side view of a second embodiment of an auxiliary wheel assembly of the present invention.
Figure 9:
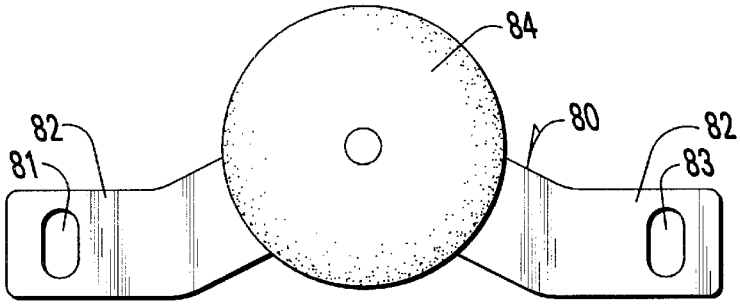
FIG. 9 is a partly diagrammatic side view of a third embodiment of an auxiliary wheel assembly of the present invention.

Referring now to FIG. 7 to 9, there are shown several versions of adjustable auxiliary-wheel assemblies. In each, the elevation of the auxiliary wheel can be modified to suit skater preference. In FIG. 7 the mounting member 70 is a single-piece element configured as a squat inverted T-shape, the bottom cross bar 72 providing sites 71, 73 (orifices) for mounting to the primary-wheel axles (not shown) and the auxiliary wheel 74 being mounted on the center stem or trunk member 76. The center trunk member 76 has an elongated mounting way 78, and the auxiliary wheel 74 can be mounted at high or low positions along that way 78. In FIG. 8 the mounting member 80 is a single-piece element configured as a wing-ended inverted U-shape, the bottom wings or feet 82 providing sites 81, 83 (somewhat elongated orifices) for adjustable mounting to the primary-wheel axles (not shown) and the auxiliary wheel 84 being stationarily mounted at the center of the mounting member 80 about half-way between the feet elements 82. The elongated orifices 81, 83 are mounting ways, and the auxiliary wheel 84 can be positioned at a high or low position by mounting the mounting member 80 at high or low positions along those ways. The center of the mounting member 80 must of course be bulged forward if there is a standard screw head on the side opposite the auxiliary wheel 84. In the embodiment of FIG. 8 the mounting member 90 is a two-piece element, the two pieces or arms 91, 93 joined together and rotatably journalled at the apex of an inverted V-shape configuration, the bottom or far ends 92 providing sites for adjustable mounting to the primary-wheel axles (not shown) and the auxiliary wheel 94 being rotatably mounted on the center. The ends 92 each have an elongated, partially slotted mounting way 98, and the auxiliary wheel 94 can be positioned at a high or low position by mounting the mounting member 90 at high or low positions along those ways 98. In addition, the distance between the ways 98 can be adjusted by swinging the arms 91, 93 closer together or farther apart at their end sections 92, such as shown by phantom lines in FIG. 8 showing the arms 91, 93 at a relative closer position. In addition, when the arms 91, 93 are moved closer together, the auxiliary wheel 94 is positioned higher relative to the ways 98, and when the arms 91, 93 are moved apart, the auxiliary wheel is positioned lower relative to the ways 98. The other components and method of skating in these alternate embodiments are as described elsewhere herein and for simplicity purposes will not be repeated.

The present invention in broad embodiment is an in-line skate comprised of a foot-retention member, a primary-wheel assembly affixed to the bottom of said foot-retention member, the primary-wheel assembly having a wheel-mounting frame and a plurality of primary wheels, and an auxiliary-wheel assembly having an a auxiliary wheel rotatably mounted on the skate in a raised position relative the primary wheels. The foot-retention member would most conventionally be a shoe boot such as described above, but of course could be other than a full foot receiving component. Instead for instance it could be a structure that is secured by straps or otherwise to street shoes or boots or the like. In preferred embodiments, the wheel-mounting frame is comprised of a pair of substantially parallel spaced-apart flange members, the primary wheels are mounted between the flange members and the auxiliary-wheel assembly is mounted at the outside surface of one of the flange members. In more preferred embodiments the primary wheels are mounted between the flange members on separate primary-wheel axles, each of the axles bridging the flange members and being journalled therein and the auxiliary-wheel assembly is mounted at the outside surface of one of the flange members on a plurality of the primary-wheel axles. When the foot-retention member is formed with an inner side and an outer side corresponding to respectively the inner and outer sides of a human foot, the pair of flange members is preferably comprised of an inner flange member positioned towards the inner side of the foot-retention member and an outer flange member positioned towards the outer side of the foot-retention member and the auxiliary-wheel assembly is mounted at the outside surface of the inner flange member. Preferably the auxiliary-wheel assembly is comprised of an auxiliary wheel mounted for rotation on an auxiliary-wheel axle journalled onto a mounting member having a first and a second arm member, preferably wherein the first and second arm members are each mounted at the outside surface of one of the flange members on a primary-wheel axle. In other preferred embodiments the lower-most point of the auxiliary wheel is about one inch higher than the lower-most point of the primary wheels.

The present invention also is, in broad embodiment, an auxiliary-wheel assembly for an in-line skate comprising an auxiliary wheel mounted for rotation on an auxiliary-wheel axle journalled onto a mounting member. In preferred embodiment, the mounting member is comprised of a pair of arm members, the arm members overlapping and each having a skate-mounting orifice.

Figure 10:
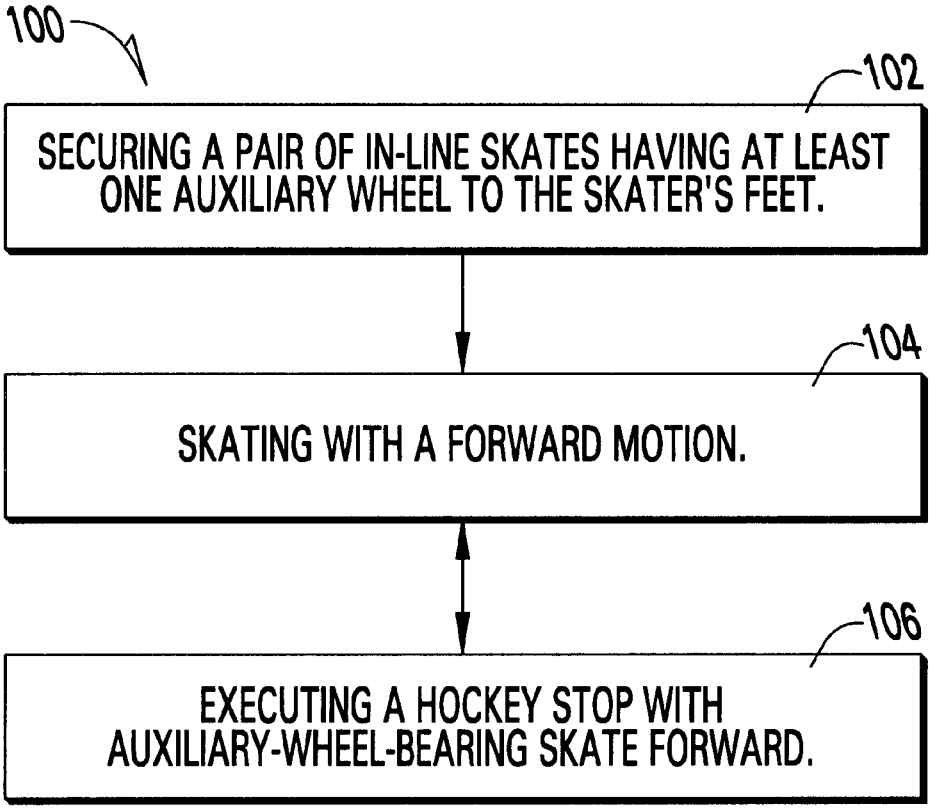
FIG. 10 is a flow diagram of the method of the invention.

Referring now also to the flow diagram of FIG. 10, the present invention also is, in broad embodiment, a method of in-line skating 100 comprised of the steps of (1) securing to the skater's feet a pair of in-line skates 102, at least one of which skates has (a) a foot-retention member, (b) a primary-wheel assembly affixed to the bottom of the foot-retention member, the primary-wheel assembly having a wheel-mounting frame and a plurality of primary wheels, and (c) an auxiliary-wheel assembly having an auxiliary wheel rotatably mounted on the skate in a raised position relative a plurality of the primary wheels, (2) then skating on a skating surface with a forward motion 104 and (3) then performing a hockey stop 106 arresting the forward motion by turning the skates transverse to the direction of the forward motion, while leaning the skates away from the direction of forward motion until the auxiliary wheel touches the skating surface concomitantly with the primary wheels.

In preferred embodiments of the method of in-line skating, in the step of securing to the skater's feet a pair of in-line skates, the auxiliary wheel is positioned on the inside of one of the feet and in the step of performing a hockey stop arresting the forward motion, the foot bearing the auxiliary wheel is positioned forward of the other foot.

In further preferred embodiments of the skating method, in the step of securing to the skater's feet a pair of in-line skates, both of the skater's feet are secured in skates having (a) a foot-retention member, (b) a primary-wheel assembly affixed to the bottom of the foot-retention member, the primary-wheel assembly having a wheel-mounting frame and a plurality of primary wheels, and (c) an auxiliary-wheel assembly having an auxiliary wheel rotatably mounted on the skate in a raised position relative a plurality of the primary wheels. Preferably the foot-retention member is formed with an inner side and an outer side corresponding to respectively the inner and outer sides of the foot, and the auxiliary wheel is rotatably mounted on the inner side of the skate. Preferably the wheel-mounting frame is comprised of a pair of substantially parallel spaced-apart flange members and the primary wheels are mounted between the flange members, and then the auxiliary-wheel assembly is preferably mounted at the outside surface of one of the flange members. Preferably the primary wheels are mounted between the flange members on separate primary-wheel axles, each of the axles bridging the flange members and being journalled therein, and then preferably the auxiliary-wheel assembly is mounted at the outside surface of one of the flange members on a plurality of the primary-wheel axles. Preferably the auxiliary wheel is mounted for rotation on an auxiliary-wheel axle journalled onto a mounting member having a first and a second arm member, and preferably the first and second arm members are each mounted on a primary-wheel axle. Even more preferably, the primary wheel axles on which are mounted the first and second arm member are adjacent axles of adjacent primary wheels.

The present invention thus provides the important ability to stop, which is a safety issue for even the most casual recreational skater. Moreover, it alleviates the inability to execute hockey stops on in-line skates and thus eliminates that limitation on the training usefulness of in-line skates for the sport of ice hockey, and the detraction from the sport of roller hockey. Unlike a typical bumper type of braking accessory, the present invention permits stops that are both abrupt and resemble the feel and movement of an ice hockey stop.

The present invention provides the ability to perform a hockey stop on in-line skates without any substantial alteration of the standardized in-line skate or wheels. In fact, in preferred embodiment the auxiliary wheel itself is an offthe-shelf in-line skate wheel. The skates of the present invention, and skates on which the auxiliary wheel is mounted, do not depart from the simple norm, nor are equipped with conspicuous appendages. The primary wheels remain standard wheels having standard replacements that are readily available by mass merchandisers. The present invention provides a solution to a serious problem that will not meet with consumer resistance. Moreover, particularly in preferred embodiments, the auxiliary wheel assembly of the present invention is an accessory that is inexpensive and can readily be fitted to standard in-line skates.

The present invention provides a means for readily performing a hockey stop on in-line skates. The present invention provides such a means that is neither expensive nor conspicuous. The present invention provides such a means with which standard in-line skates can be readily retrofitted. The present invention provides such a means that can be used for ice-hockey training and/or roller hockey and/or strictly non-sporting recreational use by skaters of all levels of skill. The present invention provides such a means that has a broad use range, and thus a broad consumer market, and therefore will in turn have significant appeal to mass merchandisers and thereby be widely available to consumers. The present invention provides such a means that can be readily positioned or placed in accordance with a skater's personal preference.

It is well within the skill of a person in the technical field, upon becoming conversant with, or otherwise having knowledge of, the present invention, to select suitable combinations of wheels, hardware, mounting members and the like in view of the type of auxiliary wheel and/or in-line skate being designed and/or constructed.

The above described embodiments are exemplified, and the terminology is employed for illustration purposes and not limitation purposes. The present invention is not limited to the combinations and sub combinations illustrated herein.

I claim:

1. A hockey-stop facilitating in-line skate comprised of:

a foot-retention member;

a primary-wheel assembly affixed to the bottom of said foot-retention member;

said primary-wheel assembly having a wheel-mounting frame, a plurality of primary wheels positioned in a longitudinal alignment, and a plurality of primary-wheel axles;

said wheel-mounting frame is comprised of a pair of substantially parallel spaced-apart flange members;

said primary wheels are mounted between said flange members on separate primary-wheel axles, each of said primary-wheel axles bridging said flange members and being journalled therein; and an auxiliary-wheel assembly having an auxiliary wheel, an auxiliary wheel axle, and a mounting member having first and second arm members having overlapping sections, said auxiliary wheel is rotatably mounted on said auxiliary-wheel axle, said auxiliary-wheel axle is journalled onto said first and second arm members of said mounting member at said overlapping sections, said first and second arm members of said mounting member are each mounted on said primary-wheel axles on sections thereof extending beyond one of said flange members, whereby said auxiliary wheel is mounted on said skate at the side of said longitudinal alignment of primary wheels in a raised position relative a plurality of said primary wheels.

2. The in-line skate of claim 1 wherein:

said auxiliary-wheel assembly is mounted at the outside surface of one of said flange members in a position raised at least one-half inch relative a plurality of said primary wheels.

3. The in-line skate of claim 1 wherein:

said auxiliary-wheel assembly is mounted at the outside surface of one of said flange members in a position raised at least one inch relative a plurality of said primary wheels.

4. The in-line skate of claim 2 wherein:

said foot-retention member is formed with an inner side and an outer side corresponding to respectively the inner and outer sides of a human foot;

said pair of flange members is comprised of an inner flange member positioned towards the inner side of said foot-retention member and an outer flange member positioned towards said outer side of said foot-retention member; and said auxiliary-wheel assembly is mounted at the outside surface of said inner flange member.

5. The in-line skate of claim 2 wherein:

said foot-retention member is a shoe boot formed with an inner side and an outer side corresponding to respectively the inner and outer sides of a human foot;

said pair of flange members is comprised of an inner flange member positioned towards the inner side of said foot-retention member and an outer flange member positioned towards said outer side of said foot-retention member;

said primary-wheel assembly further including at least one cross brace mounted between said pair of flange members; and said auxiliary-wheel assembly is mounted at said inner flange member.

6. The in-line skate of claim 2 wherein the lower-most point of said auxiliary wheel is about one inch higher than the lower-most point of said primary wheels.

7. A hockey-stop facilitating auxiliary-wheel assembly for an in-line skate comprising:

an auxiliary wheel, an auxiliary-wheel axle, and a mounting member having a pair of arm members, said arm members having overlapping sections and each having a distal end and a skate-mounting orifice, said auxiliary wheel being mounted for rotation on said auxiliary-wheel axle, said auxiliary-wheel axle being journalled onto said mounting member about mid-way between said distal ends of said first and second arm members.

8. The auxiliary-wheel assembly of claim 7 wherein auxiliary wheel is adjustable from a high to a low position relative said mounting member.

9. A method of in-line skating comprised of:

securing to the skater's feet a pair of in-line skates comprising a first and a second skate, at least said first skate having (a) a foot-retention member, (b) a primary-wheel assembly affixed to the bottom of said foot-retention member, said primary-wheel assembly having a wheel-mounting frame, a plurality of primary wheels mounted on a plurality of primary-wheel axles, and (c) an auxiliary-wheel assembly having an auxiliary wheel, an auxiliary wheel axle, and a mounting member having first and second arm members having overlapping sections, said auxiliary wheel being rotatably mounted on said auxiliary-wheel axle, said auxiliary-wheel axle being journalled onto said first and second arm members of said mounting member at said overlapping sections, said first and second arm members of said mounting member being each mounted on said primary-wheel axles, whereby said auxiliary wheel is mounted on said skate at the side of said primary wheels in a raised position relative a plurality of said primary wheels;

then skating on a skating surface with a forward motion; and then performing a hockey stop arresting said forward motion by turning said skates transverse to the direction of said forward motion with said first skate forward-most relative to the to the direction of motion and inclining said first skate away from the direction of forward motion both until said auxiliary wheel touches said skating surface concomitantly with said primary wheels of said first skate and to a sufficient degree from upright to perform a hockey stop without falling.

10. The method of in-line skating of claim 9 wherein said wheel-mounting frame of said first skate is comprised of a pair of substantially parallel spaced-apart flange members and said primary wheels are mounted between said flange members, further including:

mounting said auxiliary-wheel assembly at the outside surface of one of said flange members.

11. The method of in-line skating of claim 9 wherein said first and second arm members are mounted on adjacent primary-wheel axles.

12. A hockey-stop facilitating in-line skate comprised of:

a foot-retention member;

a primary-wheel assembly affixed to the bottom of said foot-retention member;

said primary-wheel assembly having a wheel-mounting frame and a plurality of primary wheels positioned in a longitudinal alignment; and an auxiliary-wheel assembly having an auxiliary wheel rotatably mounted on said skate in a position raised at least one-half inch relative a plurality of said primary wheels at the side of said longitudinal alignment of primary wheels.

13. The in-line skate of claim 12 wherein:

said wheel-mounting frame is comprised of a pair of substantially parallel spaced-apart flange members;

said primary wheels are mounted between said flange members; and said auxiliary-wheel assembly is mounted at the outside surface of one of said flange members.

14. The in-line skate of claim 12 wherein:

said wheel-mounting frame is comprised of a pair of substantially parallel spaced-apart flange members;

said primary wheels are mounted between said flange members on separate primary-wheel axles, each of said axles bridging said flange members and being journalled therein; and said auxiliary-wheel assembly is mounted at the outside surface of one of said flange members on a plurality of said primary-wheel axles.

15. The in-line skate of claim 12 wherein:

said foot-retention member is formed with an inner side and an outer side corresponding to respectively the inner and outer sides of a human foot;

said pair of flange members is comprised of an inner flange member positioned towards the inner side of said foot-retention member and an outer flange member positioned towards said outer side of said foot-retention member; and said auxiliary-wheel assembly is mounted at the outside surface of said inner flange member.

16. The in-line skate of claim 12 wherein said auxiliary wheel is mounted on said skate in a position raised at least one inch relative a plurality of said primary wheels.

17. The in-line skate of claim 16 wherein:

said wheel-mounting frame is comprised of a pair of substantially parallel spaced-apart flange members;

said primary wheels are mounted between said flange members; and said auxiliary-wheel assembly is mounted at the outside surface of one of said flange members.

18. The in-line skate of claim 16 wherein:

said wheel-mounting frame is comprised of a pair of substantially parallel spaced-apart flange members;

said primary wheels are mounted between said flange members on separate primary-wheel axles, each of said axles bridging said flange members and being journalled therein; and said auxiliary-wheel assembly is mounted at the outside surface of one of said flange members on a plurality of said primary-wheel axles.

19. The in-line skate of claim 16 wherein:

said foot-retention member is formed with an inner side and an outer side corresponding to respectively the inner and outer sides of a human foot;

said pair of flange members is comprised of an inner flange member positioned towards the inner side of said foot-retention member and an outer flange member positioned towards said outer side of said foot-retention member; and said auxiliary-wheel assembly is mounted at the outside surface of said inner flange member.

20. A method of in-line skating comprised of:

securing to the skater's feet a pair of in-line skates comprising a first and a second skate, at least said first skate having (a) a foot-retention member, (b) a primary-wheel assembly affixed to the bottom of said foot-retention member, said primary-wheel assembly having a wheel-mounting frame and a plurality of primary wheels, and (c) an auxiliary-wheel assembly having an auxiliary wheel, said auxiliary wheel being rotatably mounted on said skate at the side of said primary wheels in a position raised at least one-half inch relative to a plurality of said primary wheels;

then skating on a skating surface with a forward motion; and then performing a hockey stop arresting said forward motion by turning said skates transverse to the direction of said forward motion with said first skate forward-most relative to the direction of motion and inclining said first skate away from the direction of forward motion both until said auxiliary wheel touches said skating surface concomitantly with said primary wheels of said first skate and to a sufficient degree from upright to perform a hockey stop without falling.

21. The method of in-line skating of claim 20 wherein said auxiliary wheel is mounted in a position raised at least one inch relative to a plurality of said primary wheels.

* * * * *